United States Patent [19]

Hertz et al.

[11] 4,221,942

[45] Sep. 9, 1980

[54] APPARATUS AND METHOD FOR QUENCHING AN ARC IN A GAS FLOW CIRCUIT

[75] Inventors: Walter Hertz, Erlangen-Buckenhof; Jan Stroh, Erlangen, both of Fed. Rep. of Germany

[73] Assignee: Siemens Aktiengesellschaft, Munich, Fed. Rep. of Germany

[21] Appl. No.: 860,202

[22] Filed: Dec. 13, 1977

[30] Foreign Application Priority Data

Dec. 22, 1976 [DE] Fed. Rep. of Germany ..... 2658235

[51] Int. Cl.[2] ..... H01H 33/42

[52] U.S. Cl. ..... 200/148 R; 200/147 R; 200/148 A

[58] Field of Search ..... 200/147 R, 147 A, 147 B, 200/148 A, 148 R

[56] References Cited

U.S. PATENT DOCUMENTS 4,015,095 3/1977 Bitsch et al. ..... 200/147 R

*Primary Examiner*—J. V. Truhe
*Assistant Examiner*—Morris Ginsburg
*Attorney, Agent, or Firm*—Kenyon & Kenyon

[57] ABSTRACT

An apparatus and a method for quenching an arc in a gas flow circuit breaker having both a permanent current contact and an arc contact system, wherein the motion of the contacts is made current dependent, thereby delaying or accelerating the duration of the opening of the contacts of the arc contact system as a function of the current so as to shorten the arc duration and correspondingly to increase the quenching capacity of the breaker.

9 Claims, 2 Drawing Figures

APPARATUS AND METHOD FOR QUENCHING AN ARC IN A GAS FLOW CIRCUIT

BACKGROUND OF THE INVENTION

1. Field of the Invention

This invention relates to an apparatus and a method for quenching an arc in a gas flow circuit breaker and more particularly to a blast piston (puffer) circuit breaker, having contacts movable relative to each other, which form a permanent current contact system and an arc contact system.

2. Description of the Prior Art

During operation of a circuit breaker, the permanent current contacts separate and the current then commutates to an arc current path across arc contacts, which subsequently separate and take over the interruption of the current.

The quenching capacity of such high voltage breakers is substantially dependent on the energy which is liberated by the arc in the quenching system during an interruption. This energy must be removed by the flowing quenching medium. The smaller the liberated energy, the shorter will be the current interruption. By shortening the duration of the arc and thereby reducing the converted energy, the quenching capacity of the breaker can be correspondingly increased. While an increase of the quenching capacity can also be obtained by increasing the contact velocity, this is possible only to a limited extent in a contact system for high voltage and large currents due to drive and mechanical requirements.

SUMMARY OF THE INVENTION

According to the present invention the quenching capacity for a gas flow circuit breaker with separate current paths for the permanent current and the arc current is increased by shortening the duration of the arc.

According to the present invention, the motion of the contact is made current dependent. For a predetermined current value, a negative or positive acceleration is imparted to the movable contact or electrode during the commutating of the current from the permanent current to the arc contact system in the present invention, so that the separation of the contacts and the generation of the arc are thereby either delayed or accelerated.

Therefore the opening of the arc current path contacts is delayed until the end of the respective current half wave or until beyond the current zero crossing depending on the instantaneous current value. In addition, the opening velocity of the contacts can be increased in dependence on the instantaneous current value within the half wave in such a manner that the minimum spacing of the contacts required for quenching the arc is achieved as fast as possible.

In an embodiment of an arc quenching device according to the present invention especially suited for implementing the method of the present invention, the movable contact of the arc current path is equipped with a separate drive, particularly an induction drive, which delays the contact separation and thereby the generation of the arc. The current value is chosen so that no delay of contact separation occurs if no quenching can yet take place at the next current zero crossing, i.e., the minimum quenching spacing is not yet reached.

In another embodiment of the present invention, the contact is accelerated in the direction of its motion by a separate drive. The minimum quenching distance is achieved sooner and the arc is already extinguished by the next zero crossing.

DETAILED DESCRIPTION OF THE INVENTION

Figure 1:
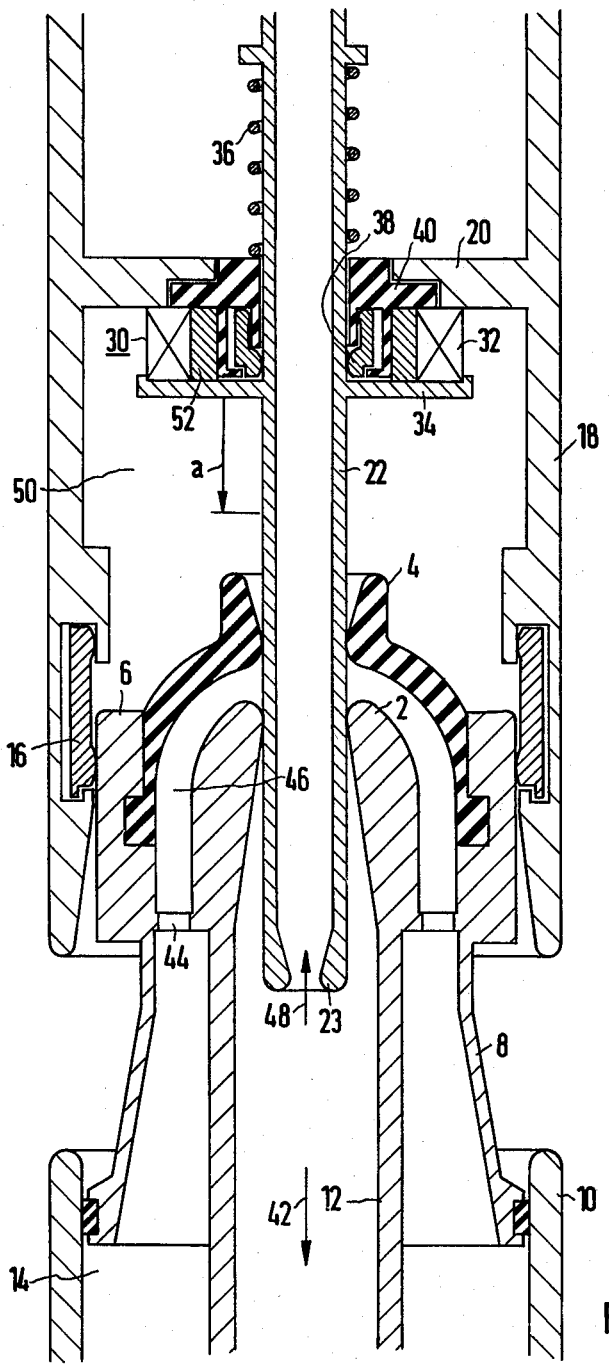
FIG. 1 is an elevational cross sectional view of an embodiment of an apparatus according to the present invention.

In the cross section of the contact system of a gas flow circuit breaker, for instance, a puffer breaker, according to FIG. 1, the electrode head assembly supports a nozzle system having a nozzle mouth 2, a nozzle 4 of insulating material, a first permanent current contact 6, and a piston 8, guided in a sliding cylinder 10. The permanent current contact 6 with the nozzle 4 and the piston 8 is rigidly connected to a contact 12. The compression chamber 14, confined by the piston 8 as well as the sliding cylinder 10 and the contact 12 may be terminated, for instance, by a flange (not shown in the figure) which provides a gas tight entrance of the tubular contact 12.

Another permanent current contact 16, which is inserted into the inside wall of a cylinder 18, is associated with the permanent current contact 6. This cylinder 18 is connected via a flange 20 directly to a movable contact 22, which may perferably also be of tubular shape and protrudes into the mouth of the contact 12. Contacts 12 and 22 form the arc current path and are movable relative to each other.

Contact 12 is equipped with a standard drive, (not shown in the figure). An additional drive 30, preferably an induction drive and particularly a magnetodynamic drive, is associated with the contact 22, which imparts to the contact a positive or negative acceleration in accordance with the present invention. Positive or negative acceleration refers to an acceleration with respect to the direction of motion of the contact. In other words, a positive acceleration is an acceleration in the direction of movement tending to make the contact move faster, whereas a negative acceleration is an acceleration in a direction opposite to the normal direction of movement tending to retard movement of the contact. Drive 30 comprises in substance a magnet coil 32, a circular flange 34 on the contact 22 serving as an induction disk, and a spring 36. The induction disk 34, which acts in principle as a Thomson ring, is attached as a flange on the hollow contact 22. The magnet coil 32, connected at one end via a sliding contact 38 to the contact 22 and at the other end (not shown in the figure) to the flange 20 or, via the cylinder 18, to the permanent current contact 16, sets up eddy currents in the induction disk 34, as soon as current flows through it. The flange 20 is separated from the contact 22 by an insulator 40. The spring 36 holds the movable electrode 22 in the normal position, as shown in FIG. 1, with an adjustable force so long as the current to be interrupted does not flow through the magnet coil 32. As an alternative to the contact 38, a flexible conductor between coil 32 and contact 22 may be used.

To extinguish a current, a drive system (not shown in the figure) associated with the movable contact 12 moves the quenching head, formed by the mouth of the contact 2, the nozzle 4 of insulating material with the permanent contact 6 and the piston 8, in the direction of the axis of the stationary contact 12, as shown in FIG. 1 by an arrow 42. This compresses a quenching gas, preferably sulfur hexafluoride, $SF_6$, in the compression chamber 14, which is connected to the nozzle space 46 via canals 44. With this motion, the current path between the permanent current contacts 6 and 16 is first opened and the current to be quenched commutates to the parallel connected arc current path of the contacts 12 and 22. It then flows via the flange 20, the magnet coil 32, the contact 38, the contact 22 and the contact 12.

If the current is below a predetermined value, the contact 22 is held in the normal position shown in FIG. 1 by the spring 36. In this case, the so called precompression of the quenching gas lasts until the mouth 23 of the electrode 22 moves out of the electrode mouth 2. Then, the metallic separation of the contacts 12 and 22 occurs and an arc is drawn between the openings 2 and 23. At the same time, the quenching gas, which is compressed in the compression chamber 14, flows into the quenching chamber 50 through the flow canals or an annular flow canal 44 as well as the nozzle space 46. The flowing quenching gas cools the arc and extinguishes it at the zero crossing. The flowing quenching gas drives the bases of the arc into the contact mouth 2 and along the contact 22, as the current decreases.

If the current exceeds a predetermined value, the additional drive 30 is actuated by the current. During the commutation of the current to the magnet coil 32, a corresponding change of the magnetic flux takes place in the magnet coil 32, whereby eddy currents are induced in a known manner in the induction disk 34 such that a repulsion force is produced between the coil and the induction disk. This force imparts to the contact 22 an acceleration in the direction of the arrow 42, i.e., in the direction of motion of the electrode 12. The spring 36 is compressed in the process. The electrode 22 moves down one stroke, which is represented linearly in FIG. 1 by an arrow a.

Figure 2:
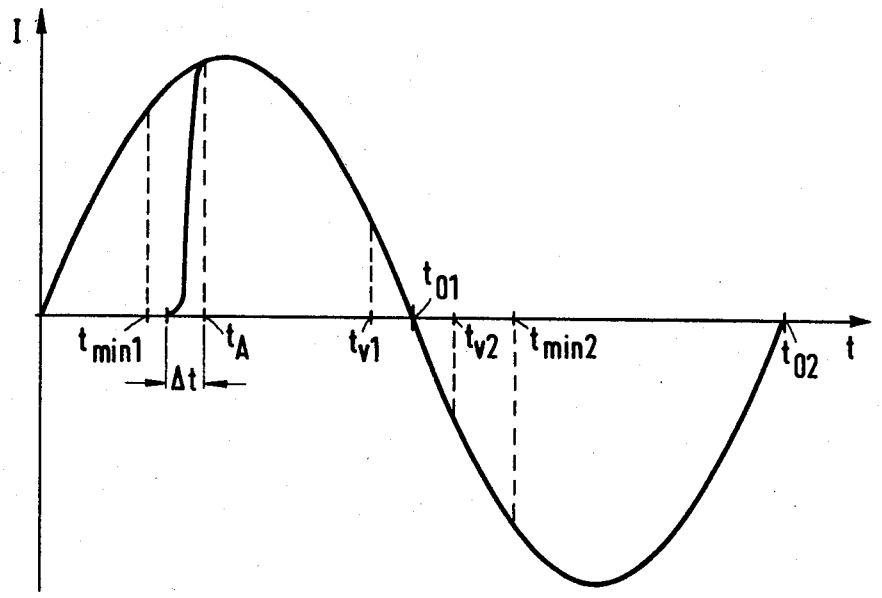
FIG. 2 is a diagramatical representation of the method of operation of the present invention.

Through this additional motion of the basically fixed electrode 22, the separation of contacts 12 and 22 and accordingly the generation of the arc are delayed, as shown in the diagram according to FIG. 2, where the current I to be quenched is plotted as a function of time t. If the current is to be interrupted at the current zero corssing at the time $t_{01}$, the separation of the contacts 12 and 22 must already take place at an instant $t_{min1}$ or even earlier, so that the required minimum quenching distance between the contact openings 2 and 23 is still reached in time. If the separation of the contacts 12 and 22 takes place only at an instant $t_A$, then the interruption of the current cannot take place during the same current half wave, i.e., up to the instant $t_{01}$. Rather the interruption takes place one half wave later, at the instant $t_{02}$. As the quenching capacity of a high voltage circuit breaker is essentially determined by the energy which is liberated by the arc in the quenching system during a quenching process and must substantially be removed by the quenching gas, the quenching system takes up a correspondingly large amount of energy in this case. According to the present invention, this energy is now substantially reduced by the fact that due to the additional acceleration of the contact 22, the opening of the mouths 2 and 23 of the contacts 12 and 22 is delayed to a later instant $t_{v1}$ prior to the end of the half wave or even to the time $t_{v2}$ in the next half wave. However, the time $t_{v2}$ must occur before a time $t_{min2}$ in the next half wave, so that quenching within the next half wave, i.e., at the zero crossing $t_{02}$ of the current, is still assured.

The mass of the contact can be designed in conjunction with the spring force of the spring 36 in such a manner that the return of the induction disk 34, caused by the spring 36, into the normal position takes place only after the arc is quenched. The accelerating force for the motion of the contact 22 is determined by the rate of change of the current (dI/dt) which is brought about in the commutation of the current from the permanent current path to the arc current path. This force is therefore effective only during an interval $\Delta t$, which is short as compared to the current half wave duration. The drive 30 is active only during this interval and accelerates the electrode 22 which then moves in accordance with the laws of motion for a mechanical system consisting of the contact 22 and the spring 36. The inductive force generated by eddy currents decreases rapidly with increasing distance between the magnet coil 32 and the induction disk 34. Therefore, the current change of the current to be quenched, which reaches its maximum at the zero crossing $t_{01}$ or $t_{02}$, no longer has an effect on the further course of the motion after the contact 22 has begun to move.

The magnet coil 32 may consist of either one or several turns. Its design depends on the magnetic force required to accelerate the contact 22 and on the instantaneous value of the current to be quenched, which determines the delay of the metallic separation of the contacts 12 and 22 and thereby the delay of the arc formation.

Another embodiment particularly advantageous for the implementation of the method according to the present invention consists of arranging in the annular space which is enclosed by the magnet coil 32, at least one additional ferromagnetic insert 52 as shown in FIG. 1 which produces an increase in the magnetic flux and thereby a corresponding increase of the magnetic force on the induction disk 34.

In some circumstances, current limiting elements, particularly a resistor, may be advantageously inserted into the arc current path, preferably into the leads of the magnet coil 32.

A further embodiment is useful in switching instances when it is most important that the minimum quenching spacing be achieved in every case as soon as possible without regard to converted energy. In such cases the drive 30 for the contact 22 must be designed so that the contact 22 is accelerated in a direction opposed to that of the arrow 42. This is made possible, in simple fashion, in an embodiment wherein the magnet coil 32 and the induction disk 34 are placed above the flange 20 while the position of spring 36 is also changed accordingly. The magnetic force on the induction disk 34 then acts in the direction of arrow 48. Due to this additional acceleration of the electrode 22, the minimum quenching distance of the contact mouths 2 and 23 is obtained faster, so that in many cases, the quenching of the arc can still take place at the next zero crossing of the current.

What is claimed is:

1. In a gas flow circuit breaker including a permanent current contact system and an arc current contact system, each having first and second contacts, the first contact of the permanent current contact system and the first contact of the arc current contact system being electrically connected, and the second contact of the permanent current contact system and the second contact of the arc current contact system being electrically connected, the contacts in each system being supported for movement relative to each other in a manner such that, during opening the contacts of the permanent current contact system are first separated from a normal at rest position, followed by a separation of the contacts of the arc current contact system, between the contacts of which an arc is drawn, a method of improving quenching comprising, controlling the relative velocity of the contacts of said arc contact system as they are separated from each other in dependence on the arc current.

2. The method of claim 1, wherein to carry out the normal switching process, the first contact of said arc current contact system is moved in a direction away from the second contact thereof, and wherein said step of controlling the relative velocity of said contacts of said arc current contact system comprises imparting an acceleration to the second of said contacts.

3. The method according to claim 2, wherein said step of imparting an acceleration comprises imparting an acceleration in the direction of motion of said first contact to thereby delay the separation of said first and second contacts of said arc current contact system.

4. In a gas flow circuit breaker including a permanent current contact system and an arc current contact system, each having first and second contacts, the first contact of the permanent current contact system and the first contact of the arc current contact system being electrically connected, and the second contact of the permanent current contact system and the second contact of the arc current contact system being electrically connected the contacts in each system being supported for movement relative to each other in a manner such that, during opening the contacts of the permanent current contact system are first separated from a normal at rest position followed by a separation of the contacts of the arc current contact system, between the contacts of which an arc is drawn, the improvement comprising means for imparting an additional motion component to at least one of said first and second contacts of said arc current contact system in dependence on the current flowing therethrough, the contact to which additional motion is imparted thereby being a driven contact.

5. The improvement of claim 4 wherein said means for imparting is an induction drive having a magnet coil.

6. The improvement according to claim 5 and further including a spring having a spring force acting in the direction of the rest position of the contacts, associated with the contact of said arc current contact system having said induction drive.

7. The improvement according to claim 6 wherein the spring is disposed about the arc contact moved by the induction drive.

8. The improvement according to claim 5 wherein said induction drive is coupled to the driven contact by a sliding contact system.

9. The improvement according to claim 5 wherein the induction drive further includes ferromagnetic inserts disposed in close proximity to said magnet coil.

* * * * *